United States Patent [19]

Bartels et al.

[11] 4,096,972

[45] Jun. 27, 1978

[54] APPARATUS FOR THE SELECTIVE DELIVERY OF PORTIONS OF A FLUID MEDIUM

[75] Inventors: Hermann Bartels, Binningen; Fritz Gallati, Zurich; Karl Lang, Uerikon; Heinz Rutishauser, Greifensee, all of Switzerland

[73] Assignee: Mettler Instrumente AG, Greifensee-Zurich, Switzerland

[21] Appl. No.: 752,601

[22] Filed: Dec. 20, 1976

[30] Foreign Application Priority Data

Feb. 6, 1976 Switzerland ..... 1459/76

[51] Int. Cl.[2] ..... B67D 5/60

[52] U.S. Cl. ..... 222/135; 23/230 R; 141/83; 222/144.5

[58] Field of Search ..... 222/144.5, 144, 14, 222/135; 141/83; 23/230 R, 253 R

[56] References Cited

U.S. PATENT DOCUMENTS

| | | | |
|---|---|---|---|
| 2,668,097 | 2/1954 | Hallikainen et al. | 23/230 R X |
| 2,770,531 | 11/1956 | Hawes et al. | 23/230 R |
| 3,015,415 | 1/1962 | Marsh et al. | 222/144 X |
| 3,029,847 | 4/1962 | Baudhuin et al. | 222/144 X |
| 3,042,259 | 7/1962 | Engel | 222/144 UX |
| 3,066,830 | 12/1962 | Heiss et al. | 222/144 X |
| 3,581,575 | 6/1971 | Butler | 222/144.5 X |
| 3,798,431 | 3/1974 | Schulkind et al. | 23/253 R |

*Primary Examiner*—Stanley H. Tollberg
*Assistant Examiner*—Fred A. Silverberg
*Attorney, Agent, or Firm*—Werner W. Kleeman

[57] ABSTRACT

An apparatus for the selective delivery of portions of fluid, comprising a plurality of fluid delivery units, each of which includes a respective conveyor for conveying fluid to be delivered. A common drive means for the plurality of delivery units which is selectively connectible to the respective conveyor thereof for selective actuation of the delivery units.

8 Claims, 5 Drawing Figures

APPARATUS FOR THE SELECTIVE DELIVERY OF PORTIONS OF A FLUID MEDIUM

BACKGROUND OF THE INVENTION

The present invention relates to a new and improved construction of apparatus for the selective delivery of portions of fluid, for example for use as dispensing apparatus in chemical or clinical laboratories.

A dispensing apparatus has been proposed in German Pat. No. 1,698,240 which comprises a plurality of delivery units in the form of pipette tips, some of which are arranged rigidly while others are arranged pivotally. Associated with each pipette tip is its own fluid conveyor means in the form of a conveyor piston and a pneumatic drive unit which displaces the piston. The individual conveyor pistons are selectively actuated by means of an arrangement of cams, electrical switches and electrically actuated valves controlled by such switches, to control the conveying movement of the pistons. Although individual pipette tips are selectively actuated, this is only in accordance with a fixed program which can be altered only by a complicated operation of replacing the cams. The apparatus is therefore only suitable in practice for automated series dispensing operations which are carried out in large numbers. There is also the expense of providing a separate drive unit for each pipette tip.

SUMMARY OF THE INVENTION

It is a general object of the present invention to provide an improved construction of apparatus for the selective delivery of portions of fluid in a manner not associated with the aforementioned drawbacks and limitations of the prior art proposals.

Another and more specific object of the present invention aims at the provision of a new and improved construction of apparatus for the selective dispensing of fluids, typically liquids, in an extremely efficient and reliable manner, which apparatus requires only a single drive for the different fluid delivery units, such drive being selectively connectible to given ones of conveyor means of the delivery units for the selective actuation of such delivery units.

Now in order to implement these and still further objects of the invention, which will become more readily apparent as the description proceeds, the invention contemplates providing an apparatus for the selective delivery of portions of fluid, comprising a plurality of fluid delivery units, each of which includes a respective conveyor means for conveying fluid to be delivered, and an actuating means which is common to said delivery units and which is selectively connectible to the respective conveyor means thereof for selective actuation of the delivery units.

According to one embodiment which can be made compact and simple, the conveyor means are arranged equidistant with respect to the common actuating means. This thus provides a circular arrangement for a multiple dispensing apparatus.

So that fluid which has been consumed in the individual delivery units can be refilled by drawing from a suitable storage vessel or reservoir, each delivery unit may have a multi-way valve and a valve actuating means common to all the valves which includes a single switch-over actuating member for switching each multiway valve between its respective operating positions.

In a preferred embodiment of the apparatus, the common actuating means includes a vertically displaceable cantilever arm which provides an entrainment means which can be selectively connected to a respective coupling member of each of the conveyor means, to transmit the conveying movement. In this arrangement the cantilever arm for the conveyor means and the abovementioned switch-over actuating member for the multi-way valves are desirably so arranged that they can be respectively connected to the same selected delivery unit.

The common actuating means preferably includes a stepping motor, as this makes it possible to perform precise and highly reproducible dispensing operations, and nonetheless the expense of the motor and its control arrangement, in relation to a single dispensing unit, can be kept relatively low.

The apparatus as will be described below is useful in the field of titration operations. Accordingly, a further manifestation of the apparatus is in the form of a multiple burette with individual conduits forming connections to at least one titrating unit. With this arrangement each titrating unit can advantageously have a multiplicity of burette tips which are each connected to a respective dispensing unit.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
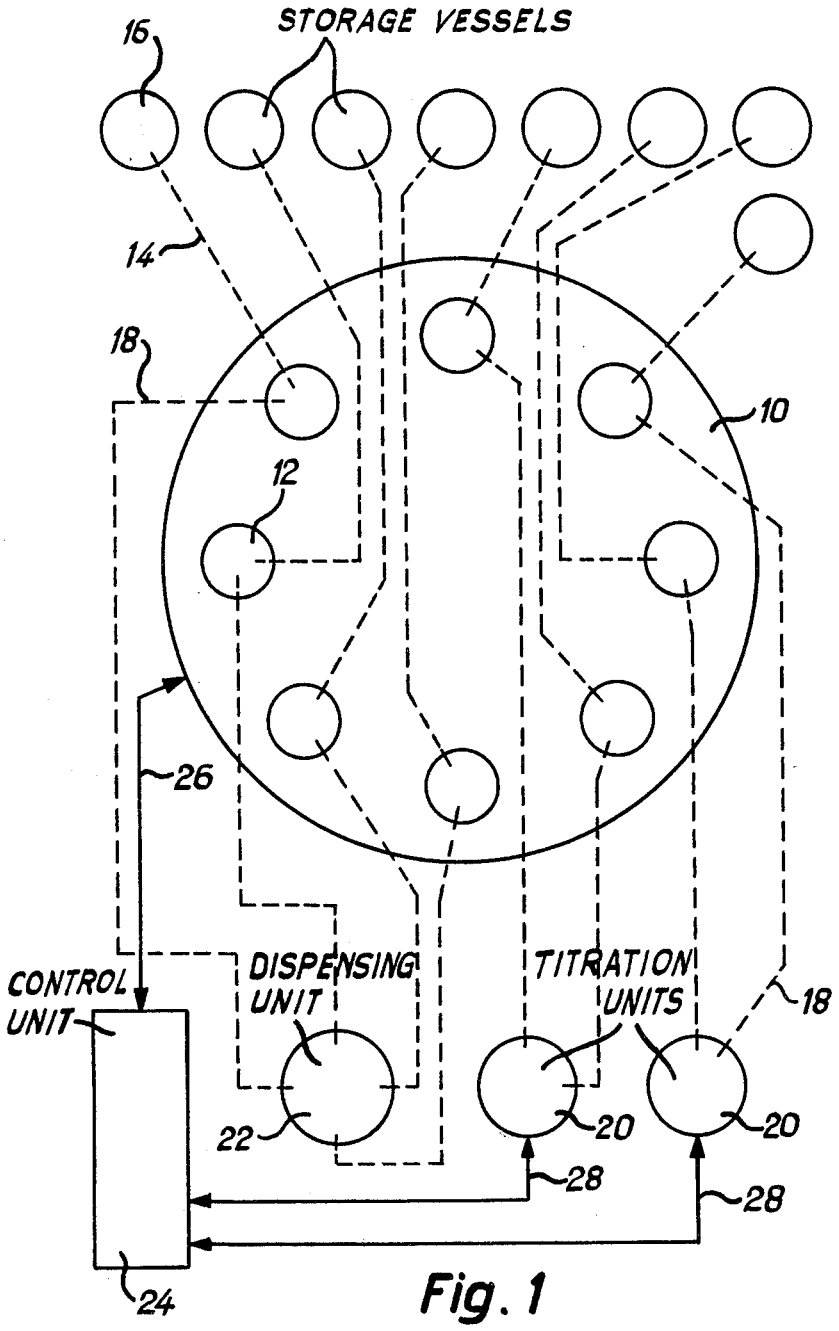
FIG. 1 illustrates a diagrammatic general plan view of the arrangement according to the invention.

Referring firstly to FIG. 1, the embodiment shown, which is selected to illustrate just one of the many possible forms of the apparatus of the invention, represents a multiple burette 10 with eight delivery units 12 arranged in a substantially circular configuration. Each delivery unit 12 is connected by way of a conduit such as a hose 14, to a respective one of eight storage vessels 16 for storing fluid to be processed by the apparatus. A further conduit, such as a hose 18, leads from each of the delivery units 12 to respective consumers of which there are three in this embodiment. More specifically, of the eight hoses 18, two are connected to each of two titrating heads of units 20 and four are connected to a dispensing unit 22.

A control unit 24 is connected by way of a power supply and signalling line 26 to the multiple burette 10 and by way of power supply and signalling lines 28 to each of the two titrating units 20.

Figure 2:
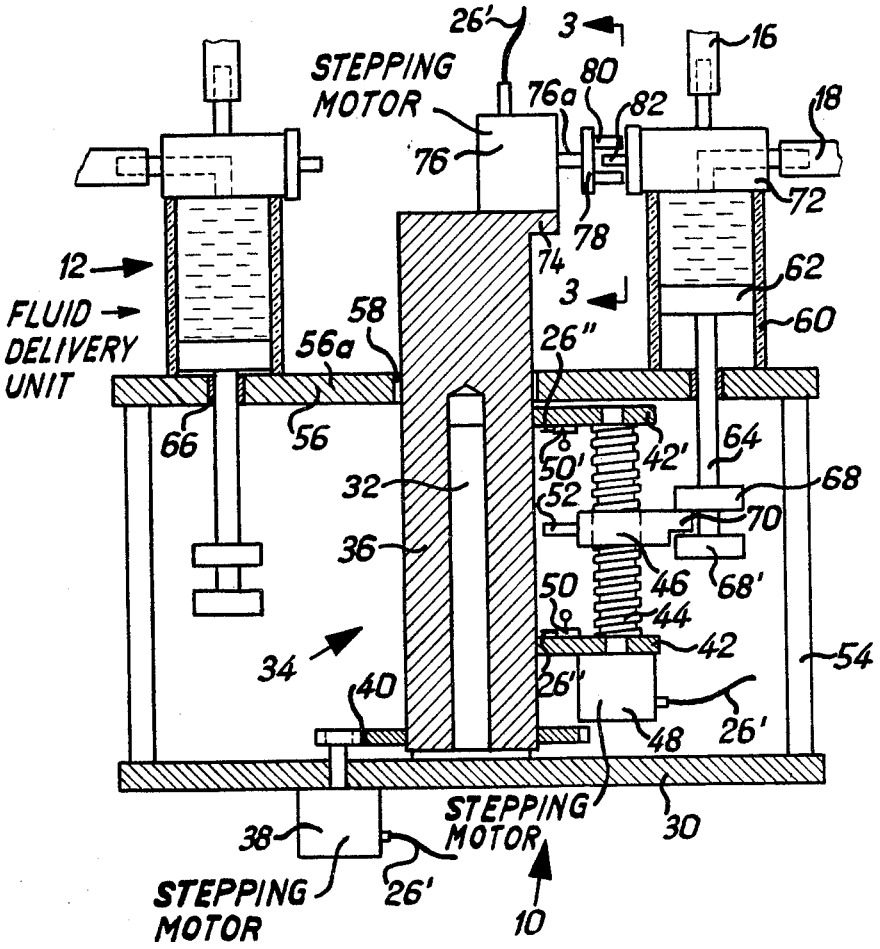
FIG. 2 illustrates a view in cross-section through the apparatus.
Figure 3:
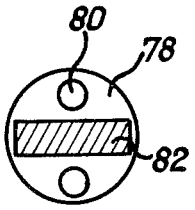
FIG. 3 illustrates a view of a detail in cross-section, taken along line 3—3 in FIG. 2.

The construction of the multiple burette 10 is shown in greater detail in FIGS. 2 and 3. Arranged approximately at the center of a base support member or bracket 30 is a vertical stationary journal pin 32. The journal pin 32 forms a mounting or support for an elongate rotary cylinder or journalled member 36 of a common drive unit 34 which is common to all the delivery units 12 as will be described in further detail hereinafter. The journalled member 36 is rotatably driven by an electrically operated drive means comprising a stepping motor 38, which is secured to the underside of the bracket 30, by way of a toothed transmission or gearing 40.

Two cantilever arms 42 and 42' are carried by the journalled member 36 at a vertical spacing from each other, and a screw-threaded spindle 44 is rotatably carried between the arms 42 and 42'. The spindle 44 carries a travelling nut 46. The spindle 44 is driven directly by a stepping motor 48 which is secured to the lower arm 42, rotation of the spindle 44 thus producing a vertical movement of the travelling nut 46. The movement of the travelling nut 46 is limited in an upward and a downward direction by respective limit switches 50 and 50', actuated by a tab 52 or equivalent structure mounted on the travelling nut 46.

An upper support member 56 is supported by columns 54, and has a central opening 58 through which the journalled member 36 projects upwardly. Mounted on the upper surface **56*a* of the support member 56 are glass cylinders 60 of the eight identical delivery units 12. Slidably disposed in each cylinder 60 is a piston 62 whose piston rod 64 is guided in a slide bearing 66 arranged in the support member 56. Each cylinder 60 and its associated piston 62 comprise a respective conveyor means of a delivery unit 12. Two plates or discs 68 and 68' comprising a coupling member are fixedly mounted on the lower end portion of each piston rod 64, with a fixed axial distance being provided between the two plates. The travelling nut 46 has a reduced portion 70 comprising an entrainment member which projects into the space between the two spaced plates 68 and 68'. The thickness of the entrainment member or projection 70 is less than the spacing between the plates 68 and 68', to provide for vertical play of such portion 70 relative to the plates 68 and 68'. The plates 68 and 68' form a connecting means for coupling the piston 62 to the drive 34. The stepping motor 48, spindle 44, travelling nut 46 and entrainment member 70** comprise a means common to all the fluid delivery units for actuating the pistons or conveyor means of the fluid delivery units.

A three-way valve 72 is provided on the upper end of each cylinder 60. The valve 72 can selectively connect the conduit 14 from the corresponding storage vessel 16, or the delivery conduit 18, to the interior of the respective cylinder 60.

A stepping motor 76 is carried on a cantilever arm 74 at the upper end of the journalled member 36, at the level of the three-way valves 72. The drive shaft **76*a* of the motor 76 extends horizontally precisely over the spindle 44 and at its end carries a vertical plate 78 with two horizontally extending lugs or rods 80 which form valve actuating means for cooperating with a flat projection 82 on the respective valves 72 (see in particular FIG. 3). The projections 82 of all eight valves 72 are disposed in a common horizontal plane, so that the arrangement comprising the components 76, 78 and 80 forms a change-over valve actuating means that is common to all the valves 72 for moving the same between their operating positions. Similarly, in the neutral or starting position of the apparatus, all the plates 68 and 68'** are disposed at the same level.

Electrical connections to the motors 38, 48 and 76 are denoted by 26', while electrical connections for the two limit switches 50 and 50' are denoted by 26''.

Figure 4:
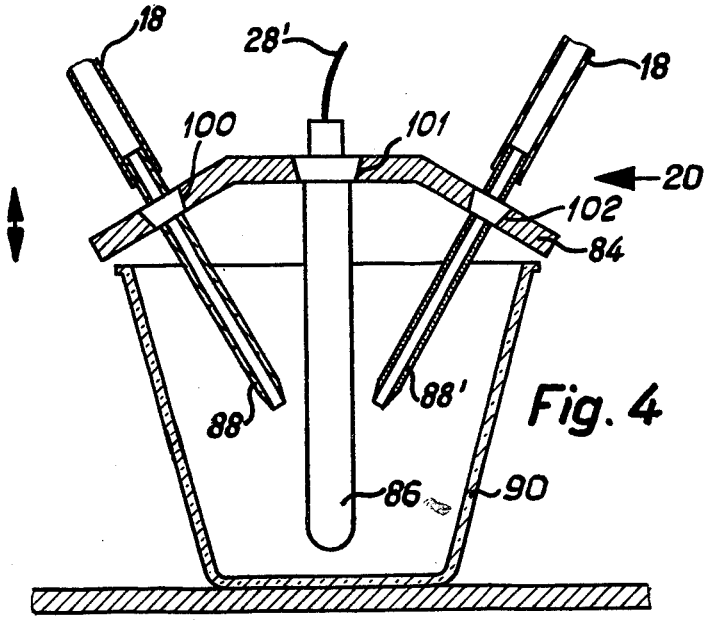
FIG. 4 illustrates a view in cross-section through a titrating unit of the apparatus.

FIG. 4 shows a view in cross-section through one of the titrating units 20. A head support plate 84 has three tapered bores 100, 101 and 102 extending therethrough. A measuring electrode 86, for measuring the electrical potential in e.g. a solution in a titration vessel 90 below the plate 84, extends through the middle bore 101, while a respective burette tip 88 and 88' projects through each of the outer bores 100 and 102 respectively, and into the titration vessel 90. The titrating unit 20 can be displaced vertically by any suitable device (not shown), in the directions indicated by the double-headed arrow, so that the titrating vessel 90 can be replaced. An electrical connection 28' connects the electrode 86 to an evaluation part of the control unit 24.

Figure 5:
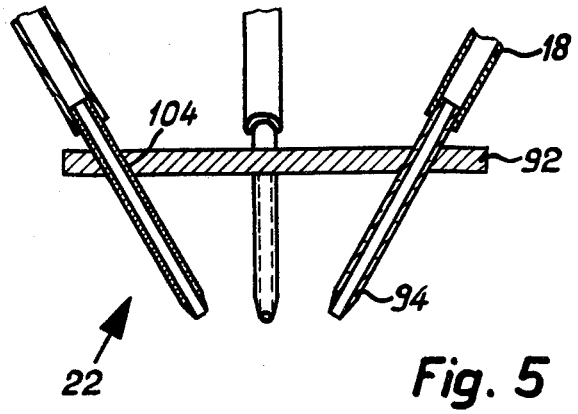
FIG. 5 illustrates a view in cross-section through a dispensing unit of the apparatus.

FIG. 5 diagrammatically shows a dispensing unit 22. A support plate 92 has four bores 104 (two of which are visible in FIG. 5) which are arranged in a circle and which are each inclined obliquely downwardly and inwardly. Fitted in each bore 104 is a respective pipette tip 94, each of which is connected by way of a hose or conduit 18 to a respective delivery unit 12.

The illustrated arrangement with eight delivery units 12 makes it possible to operate with a maximum of eight different fluids, four of these being at the dispensing unit 22 (delivery of predetermined amounts, for example solvents), and two fluids at each of the titrating units 20.

For the sake of clarity and ease of viewing of the drawings, conventional details and components have been extensively omitted from the drawings, for example radial securing means for the travelling nut 46, seals in the cylinders 60, screw means, mountings and the like.

An example of the mode of operation of the above-described multiple burette will now be described. In the following description, it is assumed that the control unit 24 (whose actual structure can vary), the details of which are unimportant for the understanding of the invention, has the necessary buttons, switches and the like, for manual control of the apparatus, as is known in this art.

In order to carry out a given titration operation to a preselected end point, a vessel 90 with a fluid sample to be tested is placed beneath the dispensing unit 22. There, a preselected amount of a given diluent is added to the sample. For this purpose the control unit 24 is used to select the appropriate delivery unit 12, and the journalled member 36 begins to rotate, stopping as soon as the entrainment member 70 of the travelling nut 46 has moved into a position between the plates 68 and 68' of the selected delivery unit 12. After the motor 38 has been switched-off, the motor 48 is switched-on and the rotary spindle 44 causes the nut 46 to move upwardly, thus pressing the piston 62 upwardly, until the preselected amount of diluent has been ejected into the vessel 90. The valve 72 forms the communication between the cylinder 60 and the hose 18. Immediately thereafter, the motor 48 reverses for return travel movement of the nut 46. At the same time, the motor 76 is started in order to rotate the three-way valve 72 from the "eject" position to the "fill" position in which the cylinder 60 communicates with the hose 14. During the downward return movement of the piston 62 to its neutral or starting position, the cylinder 60 is therefore re-filled with fluid from the storage vessel 16. When the starting position is reached, the motor 48 is switched over again to cause the nut 46 to lift for a short period of time. This period of time corresponds to a given travel movement of the nut 46 and is of such a length that the entrainment member 70 comes free from the lower plate 68' and assumes an intermediate position between the two plates 68 and 68', so that, when the drive 34 performs a rotary movement, the entrainment member 70 can pass, without contacting the plates 68 and 68', through delivery unit positions which have not been selected, and can thus be moved into a selected delivery unit position.

At the same time, the motor 76 rotates the valve 72 back to the "eject" position and thereafter also performs a short movement in the opposite direction, to release the lugs or rods 80 from the projection 82.

The multiple burette is now back in its starting position, ready for the next delivery of fluid. The vessel 90 is removed from the dispensing unit 22 and passed to a titrating unit 20. When the corresponding control commands have been imparted to the control unit 24, the titrating unit 20 is lowered, and the operation of adding a selected reagent fluid (the titrating agent) begins. The same process as described above occurs, with the difference that now the delivery of fluid is stopped when the signal from the electrode 86 (the measured potential in the solution) coincides with the preselected value introduced into the control unit.

It will be apparent that many modifications are possible without departing from the scope of the invention as defined by the appended claims. Thus, flat valves instead of the illustrated cylindrical or conical valves 72 may be used to advantage, or for example ball valves can be used. Depending on the nature of the control unit and the requirements placed upon the apparatus, the motors may be stepping motors or other motors, while in principle, the drive at 34 can be electrical and/or pneumatic. Revolution counters or (for example in the case of stepping motors) pulse counters can be provided for indicating the amounts of fluid delivered. The number of delivery units in a multiple burette can vary within relatively wide limits, this number depending inter alia on how often and which different fluids are to be used and how many of which apparatuses are to be combined together. As regards the latter aspect, besides the combination described above, namely dispensing units and titrating units, there may be apparatus constructions in which only dispensing operations are to be performed, such as in multiple dispensing devices, for example multiple diluting devices, or only a multiplicity of titration operations are to be performed. Also, the number of burette tips per titrating unit can be substantially more than two.

The use of the above-described apparatus is particularly advantageous in automated equipment controlled by means of programable computers, in which case conveyance of the sample-containing vessels to and from the individual dispensing and/or titrating units also can be effected by a mechanised device.

It will be seen that the apparatus as described above is suitable for delivering varying amounts of a number of fluids, for example the predetermined dispensing of, for example, solvents, reagents or cleaning agents, and also for use in titration operations. Both kinds of operations play a particularly large role in analysis operations, which vary frequently in respect of kind and number, in the field of wet-process chemistry (individual or short-series analysis operations). In this kind of operation, in contrast to the above-mentioned series analysis operations, a larger number of different fluids are required at irregular intervals, and this can be achieved by the above apparatus.

While there are shown and described present preferred embodiments of the invention, it is to be distinctly understood that the invention is not limited thereto, but may be otherwise variously embodied and practiced within the scope of the following claims. Accordingly,

What we claim is:

1. An apparatus for the selective delivery of portions of fluids, comprising:

a plurality of fluid delivery units, each fluid delivery unit including a respective conveyor means for conveying fluid to be delivered, said fluid delivery units being stationarily arranged along a circle having an axis;

a journalled member arranged along said axis;

means common to said fluid delivery units and carried by said journalled member for actuating the conveyor means of said fluid delivery units;

means for connecting said actuating means to the conveyor means; and electrically operated drive means connected to said journalled member for rotating said journalled member about said axis to selectively locate said actuating means and connecting means in a position for actuation of a selected fluid delivery unit.

2. The apparatus as defined in claim 1, further including:

at least one titrating unit;

said apparatus being in the form of a multiple burette;

each titrating unit having at least one burette tip; and individual conduits for connecting each burette tip to a respective fluid delivery unit.

3. The apparatus as defined in claim 1, wherein said electrically operated drive means includes an electrical stepping motor.

4. The apparatus as defined in claim 1, wherein said actuating means, connecting means and drive means are arranged within a cylindrical surface, the generatrix of which is said circle.

5. An apparatus for the selective delivery of portions of fluid, comprising:

a plurality of fluid delivery units, each fluid delivery unit including a respective conveyor means for conveying fluid to be delivered, said fluid delivery units being stationarily arranged along a circle having an axis, each delivery unit including a multi-way valve for controlling flow of fluid into and from its associated delivery unit;

a journalled member arranged along said axis;

valve actuating means common to said multi-way valves and carried by said journalled member for actuating a selected multi-way valve;

means common to said fluid delivery units and carried by said journalled member for actuating the conveyor means of said fluid delivery units;

means for connecting said actuating means to the conveyor means; and electrically operated drive means connected to said journalled member for rotating said journalled member about said axis to selectively locate said actuating means and connecting means in a position for actuation of a selected fluid delivery unit.

6. The apparatus as defined in claim 5 wherein said actuating means includes a vertically movable entrainment member, said connecting means including a coupling member for each conveyor means, said entrainment member being selectively cooperable with a selected coupling member.

7. The apparatus as defined in claim 6, wherein said entrainment and said valve actuating means are arranged to be simultaneously connected to a selected fluid delivery unit.

8. The apparatus as defined in claim 5, wherein said multi-way valve actuating means and said conveyor means actuating means each include an electrical stepping motor.

* * * * *